US009457285B2

(12) United States Patent
Rehkemper et al.

(10) Patent No.: US 9,457,285 B2
(45) Date of Patent: Oct. 4, 2016

(54) ASSEMBLY FOR TOY ENTITIES

(71) Applicant: Rehco, LLC, Chicago, IL (US)

(72) Inventors: Jeffrey Rehkemper, Chicago, IL (US); Steven Rehkemper, Chicago, IL (US); Adam Gelder, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 141 days.

(21) Appl. No.: 14/253,937

(22) Filed: Apr. 16, 2014

(65) Prior Publication Data

US 2015/0298016 A1 Oct. 22, 2015

(51) Int. Cl.

| | |
|---|---|
| ***A63H 29/20*** | (2006.01) |
| ***A63H 1/00*** | (2006.01) |
| ***A63H 17/00*** | (2006.01) |

(52) U.S. Cl.

CPC ..... *A63H 29/20* (2013.01); *A63H 1/00* (2013.01); *A63H 17/00* (2013.01)

(58) Field of Classification Search

CPC ..... A63H 1/00; A63H 1/02; A63H 17/00; A63H 17/004; A63H 29/20

See application file for complete search history.

(56) References Cited

U.S. PATENT DOCUMENTS

| | | | | |
|---|---|---|---|---|
| 1,401,952 | A * | 1/1922 | Setrak Asaturian | A63H 1/00 446/262 |
| 3,309,813 | A * | 3/1967 | Newlan | A63H 1/00 446/258 |
| 3,816,958 | A * | 6/1974 | Winston | A63H 29/20 446/462 |
| 3,932,957 | A * | 1/1976 | Morrison | A63H 29/20 446/234 |
| 4,183,174 | A * | 1/1980 | Barris | A63H 17/004 446/456 |
| 4,400,908 | A * | 8/1983 | Nomura | A63H 29/20 446/396 |
| 4,463,518 | A | 8/1984 | Smathers et al. | |
| 4,850,931 | A * | 7/1989 | Auer | A63H 29/24 180/271 |
| 5,518,437 | A | 5/1996 | Nonaka et al. | |
| 6,406,349 | B1 * | 6/2002 | Chung | A63H 1/04 446/233 |
| 6,530,817 | B1 | 3/2003 | Winslow et al. | |
| 6,805,609 | B1 | 10/2004 | Paukert et al. | |
| 7,815,486 | B2 | 10/2010 | Bernstein et al. | |
| 8,517,790 | B2 | 8/2013 | Rehkemper et al. | |
| 8,568,191 | B2 * | 10/2013 | Rehkemper | A63H 33/003 273/108 |
| 2011/0256796 | A1 | 10/2011 | Ujita et al. | |
| 2013/0056929 | A1 * | 3/2013 | Rehkemper | A63H 33/003 273/129 R |

* cited by examiner

*Primary Examiner* — Gene Kim
*Assistant Examiner* — Alyssa Hylinski
(74) *Attorney, Agent, or Firm* — Brooks Kushman P.C.

(57) ABSTRACT

A toy assembly is provided which may include a chassis defining a cavity therein, a flywheel mounted for rotation to the chassis within the cavity, a first transfer gear secured to a central portion of the flywheel and sized to mesh with a gear rack, and a clutch secured to the first transfer gear to frictionally engage the chassis and flywheel. The toy assembly may also include a housing secured to the chassis and defining a channel aligned with the first transfer gear to receive the gear rack and a spin shaft mounted to the chassis for translation between at least two positions to selectively raise at least a portion of the chassis up off of a surface therebelow. An input for rotation may have a charge wheel and be in communication with the flywheel.

17 Claims, 5 Drawing Sheets

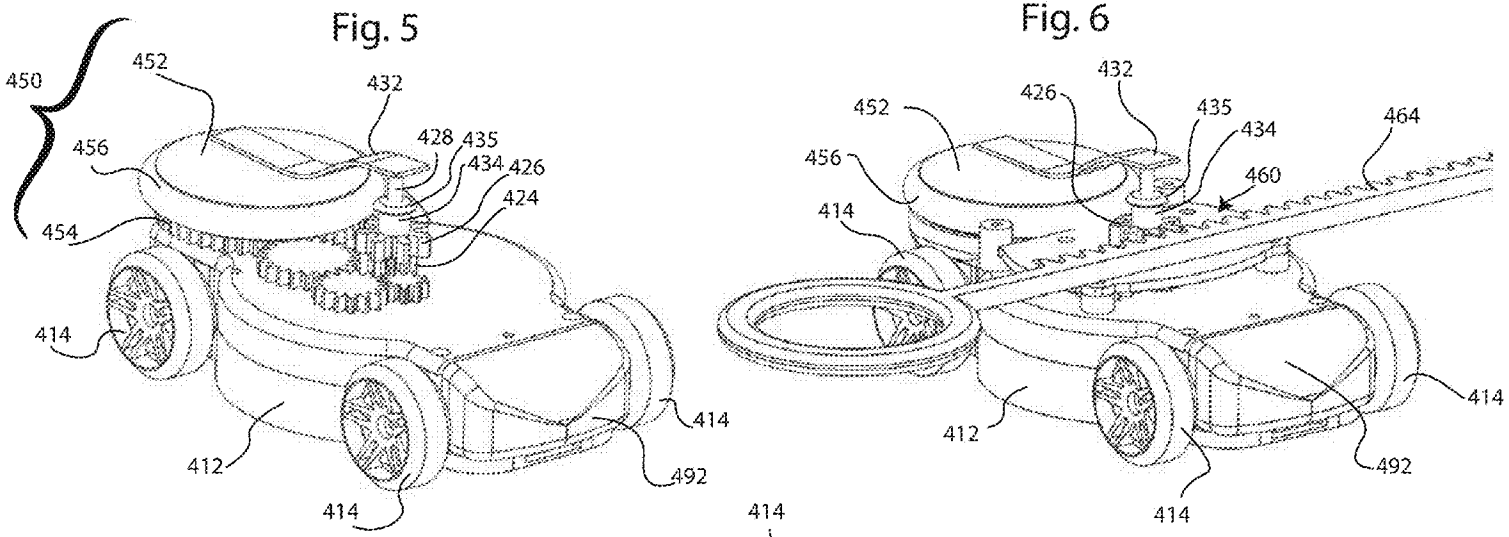
Fig. 5
Fig. 6
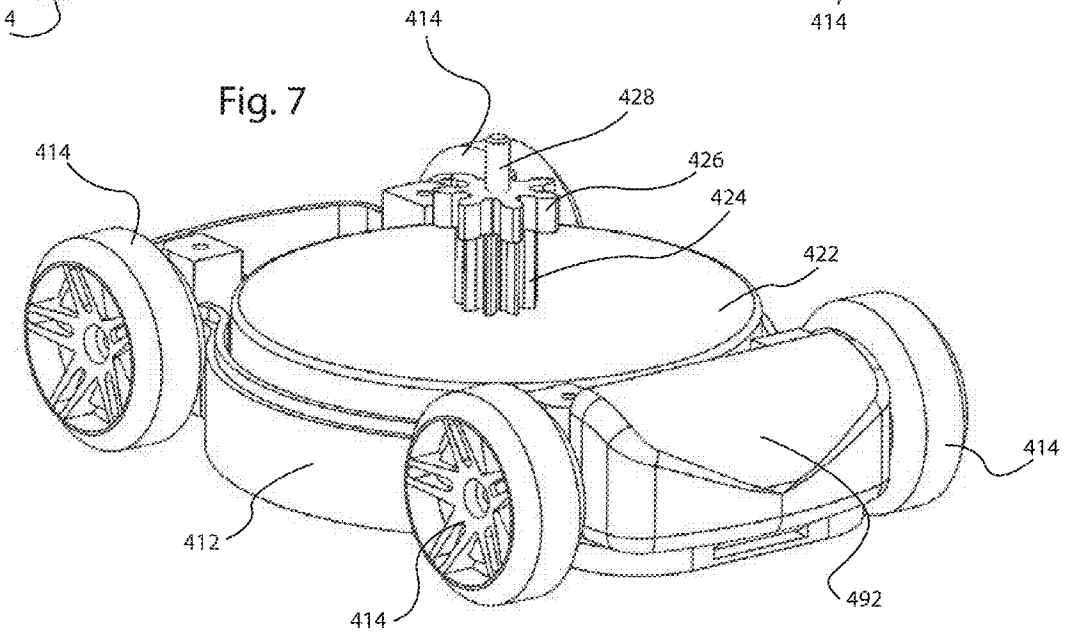
Fig. 7

ASSEMBLY FOR TOY ENTITIES

TECHNICAL FIELD

This disclosure relates to an assembly for toy entities such as toy vehicles and toy characters. An illustrative embodiment of the assembly includes a spin mechanism which may be configured to spin the toy entity about a shaft.

BACKGROUND

There have been numerous varieties of children's toys that are interactive and non-interactive. A continual need for improvements in or additions to play along with improvements in mechanics provide for new arrangements which improve, create, or change the play and interaction between a child and the toy, and also between toys. Spinning tops are one example of toys which combine science and play to provide a classic play pattern and an interaction between the child and toy. Playing with toy cars may also be considered a classic play pattern. Combining spinning tops and toy cars in the same toy may provide an expanded range of play for users.

SUMMARY

A toy vehicle includes a chassis defining a cavity, at least two wheels mounted for rotation to the chassis to support the chassis upon an underlying support surface, a shaft mounted to the chassis for translation between raised and lowered positions, and a flywheel, located within the cavity and mounted for rotation upon the shaft. The toy vehicle also includes a pin fixed to the shaft to engage the support surface and an actuator in cooperation with at least one of the pin and the shaft to selectively hold the shaft and pin in the raised position and to selectively release the pin such that the shaft moves to the lowered position. The toy vehicle also includes a clutch in cooperation with the flywheel and the chassis and a spring tab secured to the chassis in cooperation with the shaft to exert a force on the shaft and the clutch to move the shaft to the lowered position and to engage the clutch to the chassis. A transfer gear may be secured to the flywheel. A first input for rotation may be mounted to the chassis and include a charge wheel and a gear secured thereto. The charge wheel may be in mechanical cooperation with the transfer gear to transfer energy generated by rotation of the charge wheel to the flywheel. A second input for rotation may include a housing secured to the chassis to contain the flywheel and define a channel sized to receive a gear rack. The channel may be arranged with the transfer gear such that the gear rack meshes with the transfer gear when inserted into the channel. The actuator may include a segment mounted for translation to the chassis, a bumper at one end, a stopper at another end and with a raised edge about a through-hole therethrough, and a spring oriented between the stopper and the chassis to exert a force toward the shaft, so that a force opposite and greater than the force exerted by the spring against the bumper moves the segment thereby releasing the pin from the raised position. The clutch may define a lip to frictionally engage the chassis under the force generated by the spring tab such that the vehicle and flywheel spin about the shaft when the flywheel releases energy.

An assembly to spin a toy entity includes a body, a flywheel mounted for rotation within the body, first and second inputs for rotation mounted to the body and in communication with the flywheel, and a clutch to selectively engage the body and flywheel and to transfer energy therebetween. The assembly also includes a spin shaft extending through the body and mounted thereto for translation between a raised and lowered position. At least a portion the body is up off of a surface therebelow when the spin shaft is in the lowered position. The first input for rotation may include a charge wheel mounted for rotation to the chassis, an input gear secured to the charge wheel, and a first transfer gear secured to the flywheel in engagement with the input gear such that energy generated by rotation of the charge wheel transfers to the flywheel. The first input for rotation may be mounted to the body. The body may define a channel sized to receive a gear rack, and the channel may be arranged with a second transfer gear secured to the flywheel such that the gear rack meshes with the second transfer gear when inserted into the channel to facilitate a transfer of energy from the gear rack to the flywheel. Two or more wheels may be mounted for rotation to the body and sized such that the spin shaft lifts at least a portion of one of the wheels off of a surface therebelow when in the lowered position. The spin shaft may include a pin attached at a lower portion and the pin may selectively hold the spin shaft in the raised position. The assembly may include an actuator having a segment mounted for translation to the chassis, a bumper at one end, a stopper at another end and with a raised edge about a through-hole therethrough, and a spring oriented between the stopper and the chassis to exert a force toward the central shaft, so that a force opposite and greater than the force exerted by the spring against the bumper moves the segment thereby releasing the pin from the raised position. A spring tab may be secured to the body in cooperation with the spin shaft to exert a downward force on the spin shaft and the clutch to move the spin shaft to the lowered position and to engage the clutch to the body. The clutch may be fixed to a transfer gear secured to the flywheel and may define a lip to frictionally engage the body under a force applied thereto and exerted toward the flywheel.

A toy assembly includes a chassis defining a cavity therein, a flywheel mounted for rotation to the chassis within the cavity, a first transfer gear secured to a central portion of the flywheel and sized to mesh with a gear rack, and a clutch secured to the first transfer gear to frictionally engage the chassis and flywheel. The toy assembly also includes a housing secured to the chassis and defining a channel aligned with the first transfer gear to receive the gear rack and a spin shaft mounted to the chassis for translation between at least two positions to selectively raise at least a portion of the chassis up off of a surface therebelow. A second transfer gear may be in communication with the flywheel and an input for rotation having a charge wheel and a gear secured thereto and in communication with the second transfer gear to transfer energy to the flywheel. The toy assembly may include an actuator including a segment mounted for translation to the chassis, a bumper at one end, a stopper at another end and with a raised edge about a through-hole therethrough, and a spring oriented between the stopper and the chassis to exert a force toward the central shaft, so that a force opposite and greater than the force exerted by the spring against the bumper moves the segment thereby releasing the pin from the raised position. A spring tab may be secured to the chassis in cooperation with the spin shaft to exert a downward force on the spin shaft to move the spin shaft to the lowered position and to engage the clutch to the chassis. The clutch may be fixed to the transfer gear secured to the flywheel and may define a lip to frictionally engage the chassis when the spin shaft is in the lowered position such that the chassis and flywheel spin about the spin shaft when the flywheel releases energy. The chassis may be sized to be housed within a toy vehicle housing, a toy animal housing, or a toy character housing.

BRIEF DESCRIPTION OF THE DRAWINGS

FIG. 5 is a perspective view of the toy entity from FIG. 1 with a housing removed to show internal components of the toy entity including an input for rotation.

FIG. 6 is a perspective view of the toy entity from FIG. 1 with a housing removed to show internal components of the toy entity including another input for rotation.

FIG. 7 is a perspective view of the toy entity from FIG. 1 with components of the toy entity removed to show a portion of a spin mechanism.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
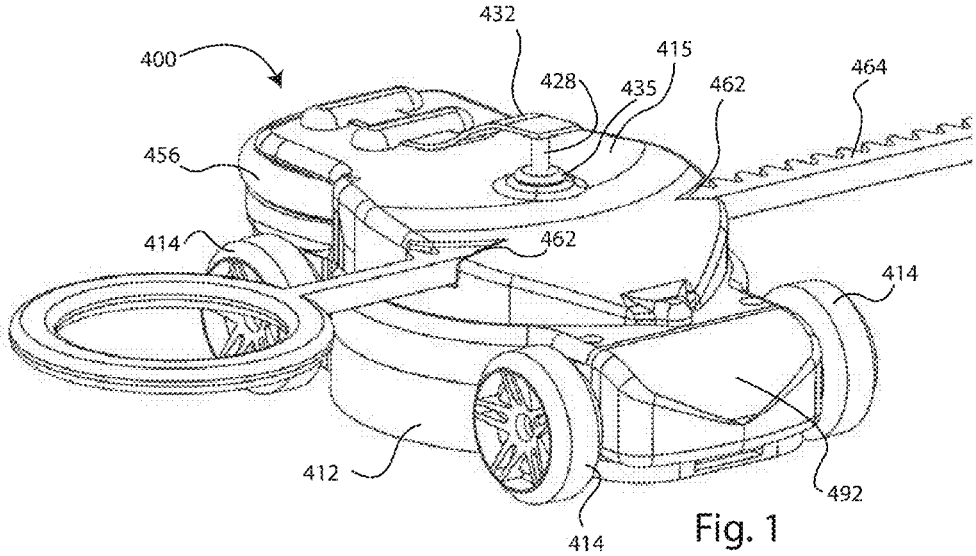
FIG. 1 is a front perspective view of a toy entity with spinning capabilities and a removable gear rack.
Figure 2:
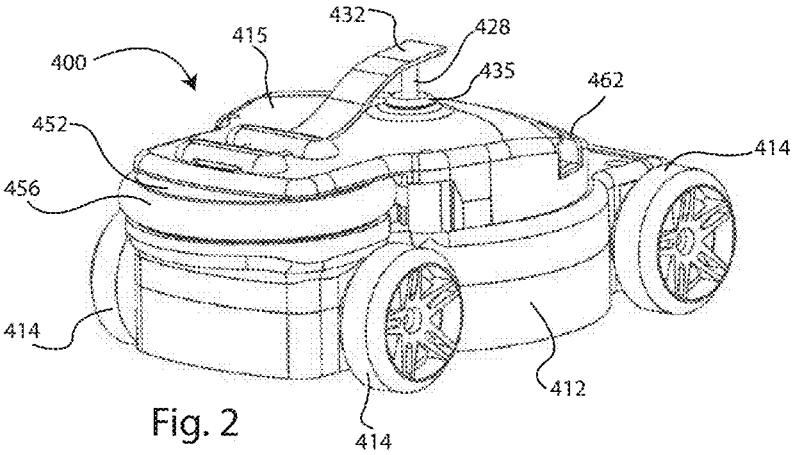
FIG. 2 is a rear perspective view of the toy entity from FIG. 1.
Figure 3:
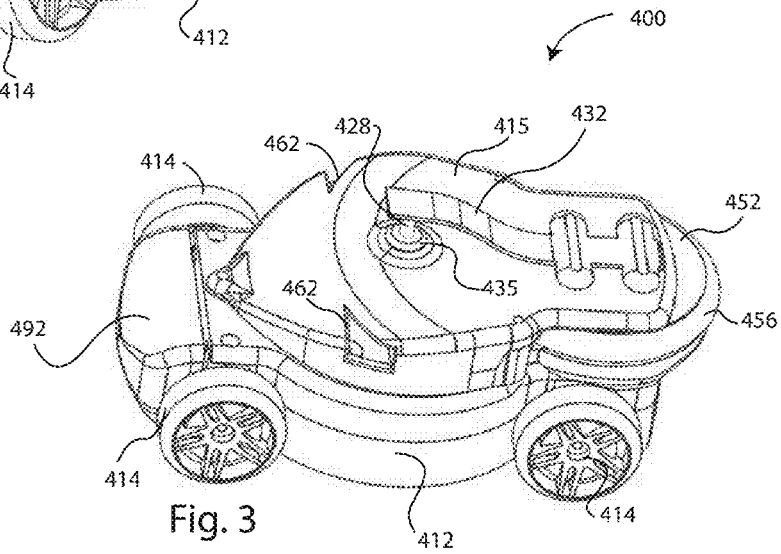
FIG. 3 is an elevated perspective view of the toy entity from FIG. 1.
Figure 4:
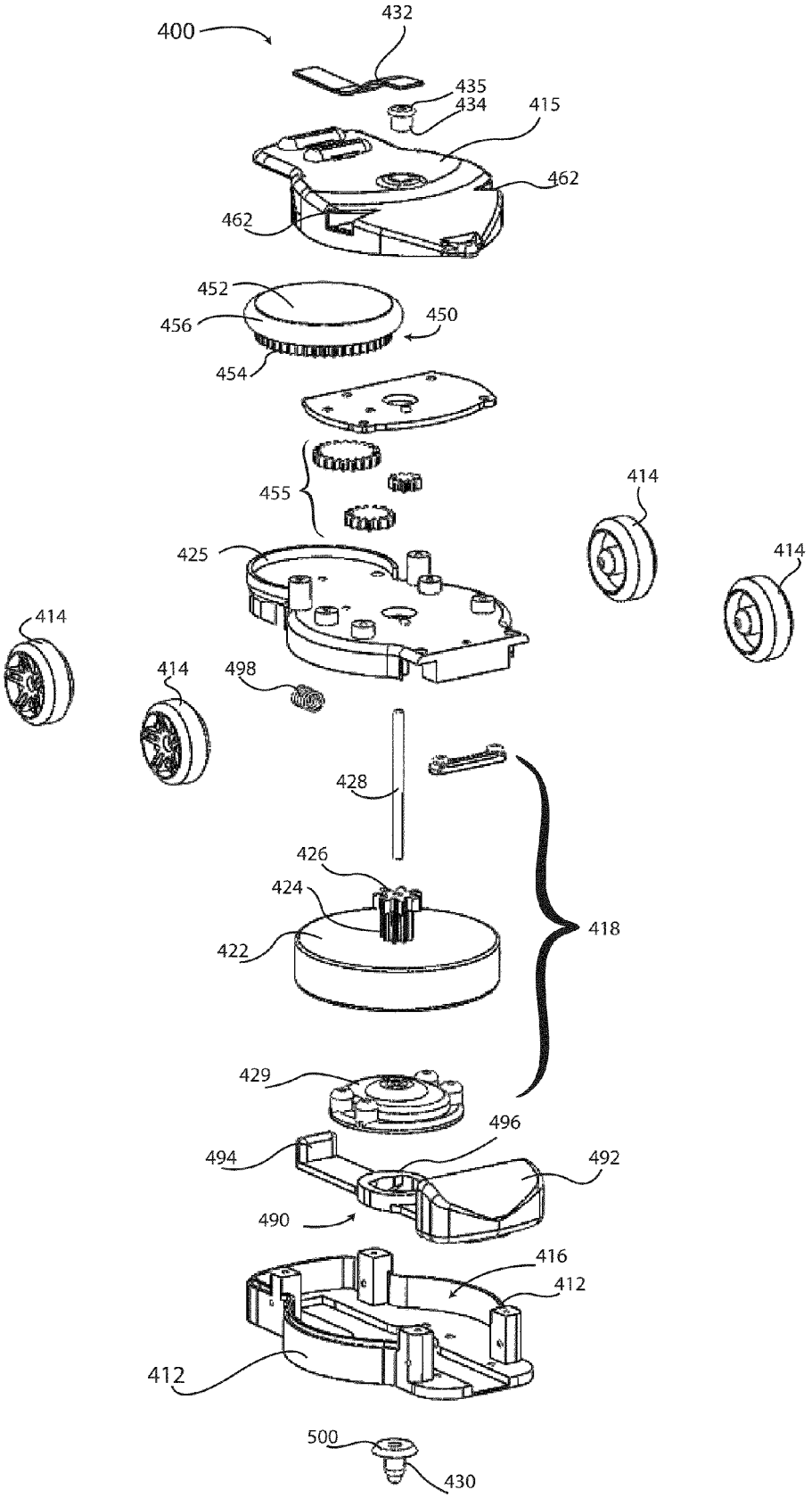
FIG. 4 is an exploded view of the toy entity from FIG. 1.

FIG. 1 shows an example of a toy entity with spinning capabilities. A toy entity 400 may include an assembly having a spin mechanism within the toy entity 400 which may be configured to raise and lower the toy entity 400 between at least a first and second position. For example, the spin mechanism may lift the toy entity 400 off of a surface in the first position and spin the toy entity 400 in a top-like manner in the second position when the spin mechanism releases energy stored therein. In this example, the toy entity 400 is shown in the form of a vehicle, however, the toy entity 400 may take on several different forms such as toy characters, toy animals, toy planes, or toy spaceships to name a few. The assembly having the spin mechanism may also be used with other toy entities as further described herein.

The toy entity 400 may include a chassis 412. Optionally, four wheels 414 may be mounted for rotation to the chassis 412. It is contemplated that alternative configurations of the wheels 414, including the number thereof, may be available. A housing 415 may be secured to the chassis 412 to contain the components of the toy entity 400. The chassis 412 may define a cavity 416 which may be sized to receive a spin mechanism 418. The spin mechanism 418 may include a flywheel 422, a first transfer gear 424, a second transfer gear 426, a spin shaft 428, and a support-housing 429. The first transfer gear 424 and the second transfer gear 426 may be fixed to the flywheel 422. Alternatively, it is contemplated that the first transfer gear 424 and the second transfer gear 426 may be a single component with appropriately sized gears to mesh with a gear train or a rack from one or more inputs for rotation. The first transfer gear 424 and the second transfer gear 426 may assist in transferring energy to the flywheel 422 as described further below. A mid-housing 425 may support one or more gear trains and one or more inputs for rotation. The support-housing 429 may support the flywheel 422 such that the flywheel 422 may spin about the spin shaft 428. The flywheel 422 and the transfer gears 424 and 426 may define a central channel sized to receive the spin shaft 428. The spin shaft 428 may extend through the central channel and include a pin member 430 at a lower portion of the spin shaft 428 and located below the flywheel 422 relative to the toy entity 400 orientation shown in FIGS. 8 and 9, among others. The pin member 430 may be configured to assist in holding the spin shaft 428 in a raised position such that the spin shaft 428 does not contact a surface below the toy entity 400. The support-housing 429 may prevent the flywheel 422 from contacting the pin member 430. The pin member 430 may also assist in providing an upward force against the spin shaft 428 which opposes a downward force generated by a spring tab 432. One end of the spring tab 432 may be secured to the toy entity 400, such as at the housing 415, and the other end may be in contact with an upper portion of the spin shaft 428. The spring tab 432 may exert a downward force on the spin shaft 428 and a clutch 434 under certain conditions. The spin shaft 428 may be located in a substantially central location within the toy entity 400 and extend through the clutch 434 located above the transfer gears 424 and 426. The clutch 434 may be fixed to the second transfer gear 426 and may selectively engage the chassis 412, the housing 415, and the flywheel 422 when a force is applied to the clutch 434.

For example, the clutch 434, the first transfer gear 424, the second transfer gear 426, and the flywheel 422 may be secured to one another to facilitate simultaneous rotation thereof. One example of selectively engaging the clutch 434 to transfer rotation to the rest of the toy entity 400 may utilize a lip 435 defined by the clutch 434. The lip 435 may extend outward of an upper portion of the clutch 434 and contact the housing 415. This contact with the housing 415 may provide an area to transfer a force exerted by the spring tab 432 to both the clutch 434 and the housing 415. Under the force exerted by the spring tab 432, the clutch 434 may frictionally engage the housing 415 and thus transfer rotation from the flywheel 422 to the chassis 412 and housing 415.

The toy entity 400 may include one or more inputs for rotation to provide energy to drive rotation of the flywheel 422. FIG. 5 shows an example of a first input for rotation 450 which may be in mechanical communication with the first transfer gear 424 such that the first input for rotation 450 may transfer energy to the flywheel 422. The first input for rotation 450 may be mounted to the toy entity 400 and include a charge wheel 452 having a gear 454 to facilitate the mechanical communication with the first transfer gear 424. In one example, a gear train 455 may assist in facilitating the mechanical communication between the first input for rotation 450 and the first transfer gear 424. The charge wheel 452 may extend outside a footprint defined by the chassis 412. This extension outside the footprint may provide clearance for a user to rotate the charge wheel 452 and/or a friction member 456. The friction member 456 may be secured about the charge wheel 452 and be made of a material with characteristics which assist in gripping the charge wheel 452 for rotation, such as rubber.

FIG. 6 shows an example of a second input for rotation 460 which may be in mechanical communication with the second transfer gear 426 such that the second input for rotation 460 may transfer energy to the flywheel 422. For example, the housing 415 may define a channel 462 sized to receive a gear rack 464. The channel 462 may be arranged with the second transfer gear 426 such that the gear rack 464 may mesh with the second transfer gear 426 when inserted in to the channel 462. Once inserted, a user may pull the gear rack 464 out of the channel 462 to drive rotation of the second transfer gear 426 and transfer energy to the flywheel 422. In one example, the gear rack 464 may be referred to as a t-strip. Components of the toy entity 400 are removed in FIG. 7 to show the flywheel 422 seated within the cavity 416. Here, the flywheel 422 is shown mounted for rotation to the support-housing 429 (not visible in FIG. 7).

Figure 9:
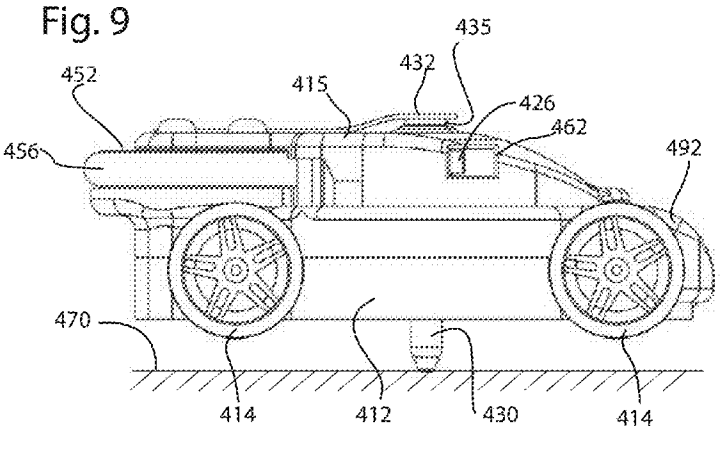
FIG. 9 is a side view of the toy entity from FIG. 1 showing the spin shaft from in a lowered position.
Figure 8:
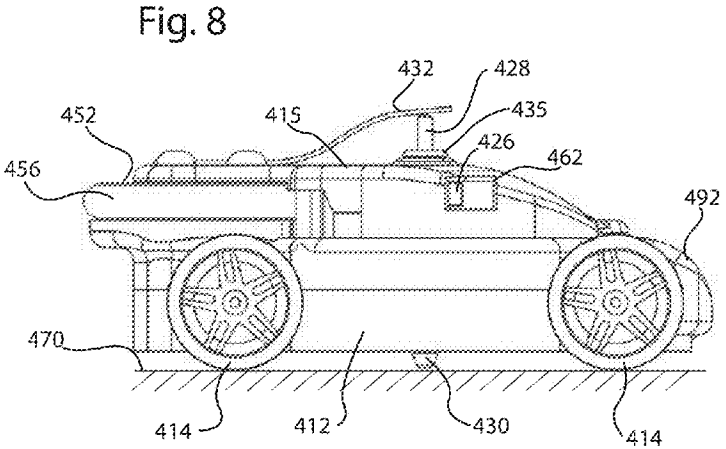
FIG. 8 is a side view of the toy entity from FIG. 1 showing a spin shaft is in a raised position.

As mentioned above, the spin mechanism 418 may raise and lower the toy entity 400 under certain conditions. FIG. 8 shows an example of the spin shaft 428 in the raised position. In this example of the raised position, the wheels 414 may be in contact with a surface 470 and the pin member 430 of the spin shaft 428 may be above the surface 470. Here, an upper portion of the pin member 430 may be held in the raised position and may counteract the opposing downward force exerted by the spring tab 432 on the spin shaft 428. FIG. 9 shows an example of the of the spin shaft 428 in the lowered position. In this example of the lowered position, the pin member 430 has been released and is in contact with the surface 470 such that at least a portion of the toy entity 400 is raised off of the surface 470 and such that the toy entity 400 may spin about the spin shaft 428.

Figure 10:
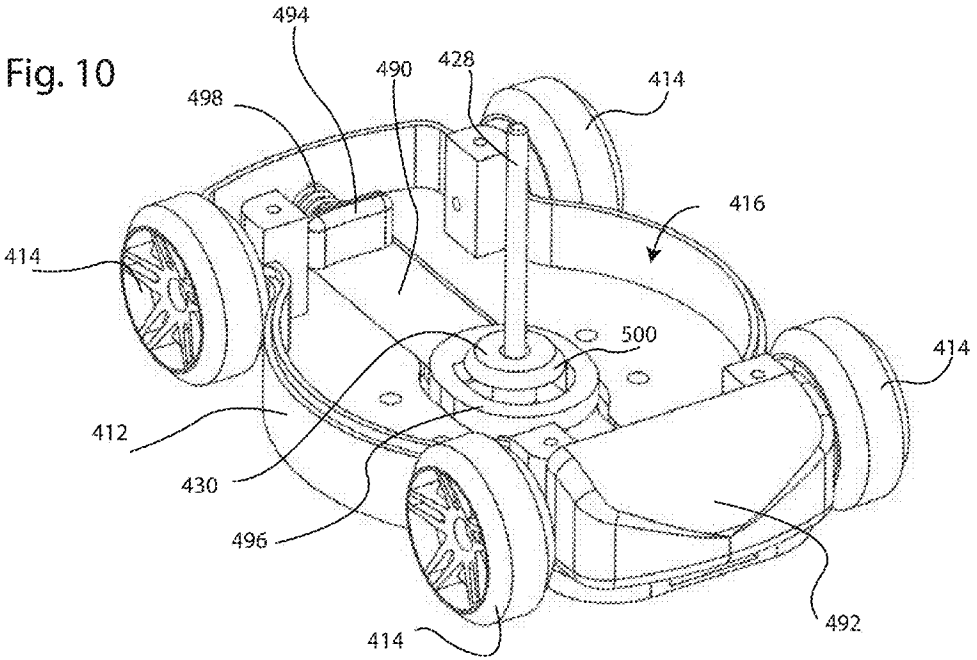
FIG. 10 is a perspective view of the toy entity from FIG. 1 with components of the toy entity removed to show an engagement assembly and the spin shaft in the raised position.

More than one actuator or engagement assembly may be available to assist in selectively engaging and releasing the pin member 430. FIG. 10 shows one example of an actuator which may include a slidable member 490 having a bumper 492 at one end and a stopper 494 at the other end. The slidable member 490 may be mounted for translation to the chassis 412 and may define a raised edge 496 about a central through-hole. A spring 498 may be located between the stopper 494 and the chassis 412 which may apply a force against the stopper 494 such that the slidable member 490 is under compression. The raised edge 496 may hold the pin member 430 while the spin shaft 428 is in the raised position and the slidable member 490 is under compression. A force applied against the bumper 492 which is greater than the force exerted against the stopper 494 by the spring 498 may move the slidable member 490 such that the raised edge 496 releases the pin member 430. When released, the spring tab 432 may push the pin member 430 and spin shaft 428 downward to the lowered position and may raise the toy entity 400 off of the surface 470 as shown previously in FIG. 9. Further, the force exerted by the spring tab 432 may be such that the spin shaft 428 is held in the lowered position.

The pin member 430 may include a tapered portion 500 to assist in moving the spin shaft 428 to the raised position. For example, the slidable member 490 may define another tapered portion (not shown) below the raised edge 496 which may compliment the tapered portion 500 to assist in pushing the slidable member 490 toward the spring 498 as the pin member 430 moves upward to the raised position. As such, a user may apply an upward force against the pin member 430 such that tapered portion 500 moves above the raised edge 496 and sits thereon when the spring 498 pushes the slidable member 490 back toward the front of the toy entity 400.

Figure 11:
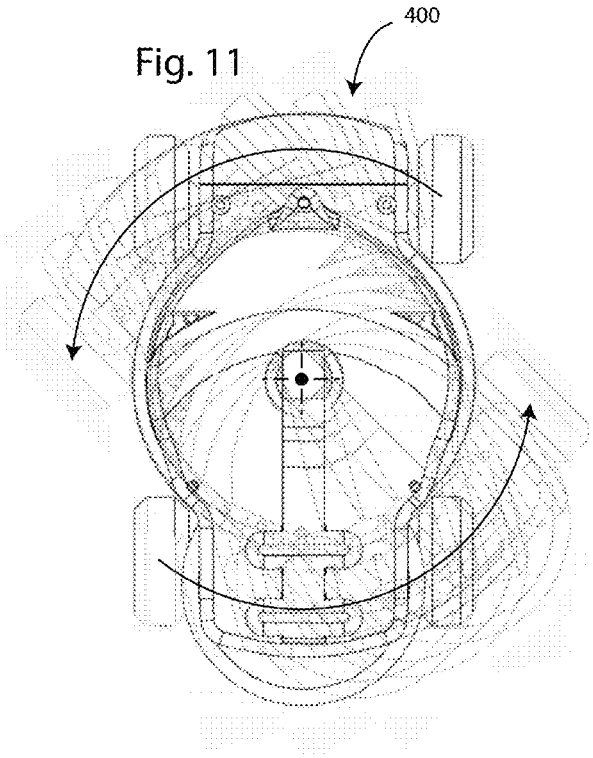
FIG. 11 is an illustrative view of the toy entity from FIG. 1 spinning about the spin shaft.
Figure 12:
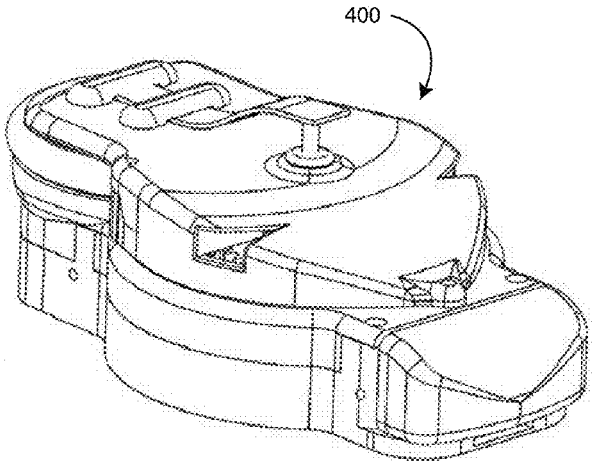
FIG. 12 is a perspective view of a non-wheeled toy assembly with spinning capabilities.
Figure 13:
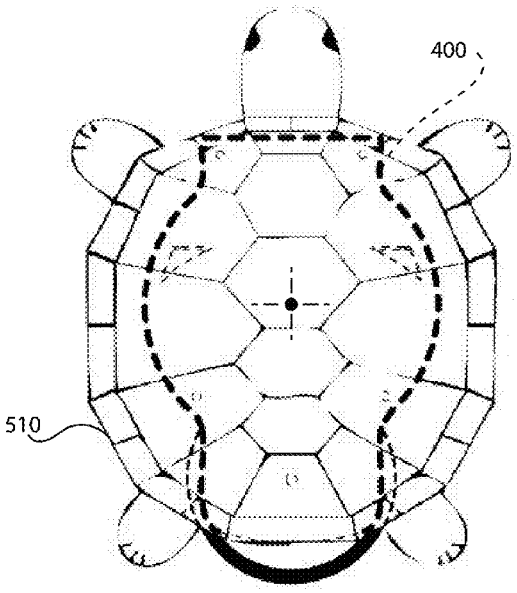
FIG. 13 is a top view of a toy character body housing the non-wheeled toy assembly of FIG. 11.
Figure 14:
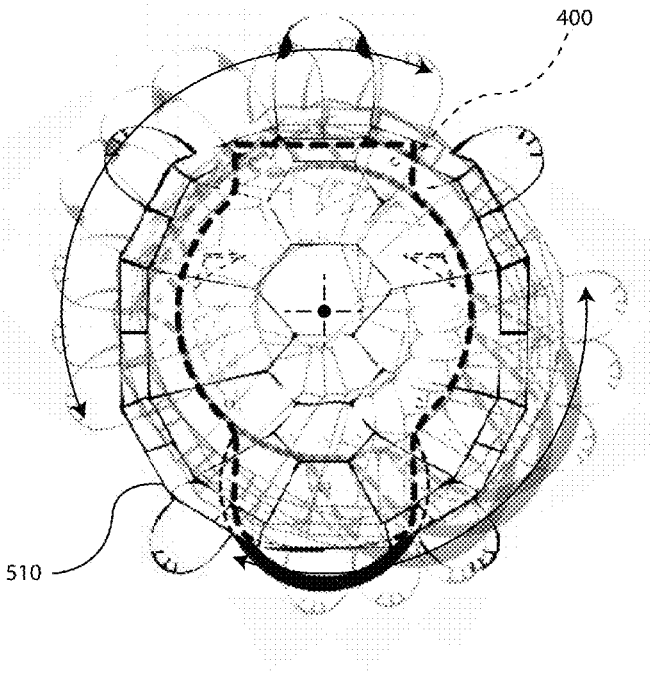
FIG. 14 is an illustrative view of the toy character body from FIG. 13 spinning about a spin shaft.

As described above, an assembly having a spin mechanism may assist in providing spinning capabilities to the toy entity 400. One or more inputs for rotation, such as the first input for rotation 450 and the second input for rotation 460, may supply energy via a user to rotate the flywheel 422 such that the chassis 412 and the housing 415 spin when the clutch 434 engages the flywheel 422, the chassis 412, and the housing 415 as illustrated in FIG. 11. Providing an equal weight distribution or a substantially equal weight distribution of the components of the toy entity 400 may assist in improved spin performance. While the toy entity 400 is shown in the form of a vehicle as described above, the components of the toy entity 400 may also provide spinning capabilities to other forms of toy entities. For example, FIG. 12 shows the toy entity 400 without the wheels 414. FIG. 13 shows the toy entity housed within a turtle housing 510 and spinning about the spin shaft 428 in FIG. 14.

As such, the toy entity 400 and components thereof may provide one or more onboard and self-contained inputs for rotation to charge a flywheel such that a user may play with the toy entity 400 in more than one play pattern. For example, the user may play with the toy entity 400 as a vehicle or character, and/or as a spinning top. Additionally, multiple toy entities 400 may be incorporated into game play between one or more users such that the toy entities 400 may interact with one another.

While various embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A toy vehicle comprising:

a chassis defining a cavity;

at least two wheels mounted for rotation to the chassis to support the chassis upon an underlying support surface;

a shaft mounted to the chassis for translation between raised and lowered positions;

a flywheel located within the cavity and mounted for rotation upon the shaft;

a pin fixed to the shaft to engage the support surface;

an actuator in cooperation with at least one of the pin and the shaft to selectively hold the shaft and pin in the raised position and to selectively release the pin such that the shaft moves to the lowered position;

a housing secured to the chassis;

a clutch in cooperation with the flywheel and the chassis; and a spring tab externally secured to the housing and in cooperation with the shaft to exert a force on the shaft and the clutch to move the shaft to the lowered position and to engage the clutch to the chassis.

2. The toy vehicle of claim 1, further comprising a transfer gear secured to the flywheel.

3. The toy vehicle of claim 2, further comprising a first input for rotation mounted to the chassis, comprising a charge wheel and a gear secured thereto, the charge wheel being in mechanical cooperation with the transfer gear to transfer energy generated by rotation of the charge wheel to the flywheel.

4. The toy vehicle of claim 3, further comprising a 1 second input for rotation comprising the housing secured to the chassis containing the flywheel and defining a channel sized to receive a gear rack, wherein the channel is arranged with the transfer gear such that the gear rack meshes with the transfer gear when inserted into the channel.

5. The toy vehicle of claim 1, wherein the actuator further comprises:

a segment mounted for translation to the chassis;

a bumper at one end;

a stopper at another end and with a raised edge about a through-hole therethrough; and a spring oriented between the stopper and the chassis to exert a force toward the shaft, so that a force opposite and greater than the force exerted by the spring against the bumper moves the segment thereby releasing the pin from the raised position.

6. The toy vehicle of claim 1, wherein the clutch defines a lip to frictionally engage the chassis under the force generated by the spring tab such that the vehicle and flywheel spin about the shaft when the flywheel releases energy.

7. An assembly to spin a toy entity comprising:

a body;

a flywheel mounted for rotation within the body;

first and second inputs for rotation mounted to the body and each input in communication with the flywheel such that both inputs may separately charge the flywheel;

a clutch to selectively engage the body and flywheel and to transfer energy therebetween;

a spin shaft extending through the body, including a pin attached at a lower portion to selectively hold the spin shaft in a raised position, and mounted thereto for translation between the raised and a lowered position, wherein at least a portion the body is up off of a surface therebelow when the spin shaft is in the lowered position; and an actuator including a segment mounted for translation to the body, a bumper at one end, a stopper at another end and with a raised edge about a through-hole therethrough, and a spring oriented between the stopper and the body to exert a force toward the spin shaft, so that a force opposite and greater than the force exerted by the spring against the bumper moves the segment thereby releasing the pin from the raised position.

8. The assembly of claim 7, wherein the first input for rotation comprises:

a charge wheel mounted for rotation to the body;

an input gear secured to the charge wheel; and a first transfer gear secured to the flywheel in engagement with the input gear such that energy generated by rotation of the charge wheel transfers to the flywheel, and wherein the first input for rotation is mounted to the body.

9. The assembly of claim 8, wherein the body defines a channel sized to receive a gear rack, and wherein the channel is arranged with a second transfer gear secured to the flywheel such that the gear rack meshes with the second transfer gear when inserted into the channel to further define the second input for rotation and to facilitate a transfer of energy from the gear rack to the flywheel.

10. The assembly of claim 9, further comprising two or more wheels mounted for rotation to the body and sized such that the spin shaft lifts at least a portion of one of the wheels off of a surface therebelow when in the lowered position.

11. The assembly of claim 7, further comprising a spring tab secured to the body in cooperation with the spin shaft to exert a downward force on the spin shaft and the clutch to move the spin shaft to the lowered position and to engage the clutch to the body.

12. The assembly of claim 7, wherein the clutch is fixed to a transfer gear secured to the flywheel and defines a lip to frictionally engage the body under a force applied thereto and exerted toward the flywheel.

13. A toy assembly comprising:

a chassis defining a cavity therein;

a flywheel mounted for rotation to the chassis within the cavity;

a first transfer gear secured to a central portion of the flywheel and sized to mesh with a gear rack;

a clutch secured to the first transfer gear to frictionally engage the chassis and flywheel;

a housing secured to the chassis and defining a channel aligned with the first transfer gear to receive the gear rack a spin shaft mounted to the chassis for translation between at least two positions to selectively raise at least a portion of the chassis up off of a surface therebelow; and an actuator including a segment mounted for translation to the chassis, a bumper at one end, a stopper at another end and with a raised edge about a through-hole therethrough, and a spring oriented between the stopper and the chassis to exert a force toward the spin shaft, so that a force opposite and greater than the force exerted by the spring against the bumper moves the segment thereby releasing the spin shaft from a raised position of the positions.

14. The assembly of claim 13, further comprising a second transfer gear in communication with the flywheel and an input for rotation having a charge wheel and a gear secured thereto and in communication with the second transfer gear to transfer energy to the flywheel.

15. The assembly of claim 13, further comprising a spring tab secured to the chassis in cooperation with the spin shaft to exert a downward force on the spin shaft to move the spin shaft to a lowered position of the positions and to engage the clutch to the chassis.

16. The assembly of claim 15, wherein the clutch is fixed to the transfer gear secured to the flywheel and defines a lip to frictionally engage the chassis when the spin shaft is in the lowered position such that the chassis and flywheel spin about the spin shaft when the flywheel releases energy.

17. The assembly of claim 13, wherein the chassis is sized to be housed within a toy vehicle housing, a toy animal housing, or a toy character housing.

* * * * *